United States Patent [19]

Boretski

[11] Patent Number: 5,038,426

[45] Date of Patent: Aug. 13, 1991

[54] PORTABLE BASSINET

[76] Inventor: Daliah Boretski, 2429 Cheremoya Ave., Hollywood, Calif. 90068

[21] Appl. No.: 577,286

[22] Filed: Sep. 4, 1990

Related U.S. Application Data

[63] Continuation-in-part of Ser. No. 512,768, Apr. 23, 1990, abandoned.

[51] Int. Cl.[5] ..... A47D 13/02; A47D 7/00

[52] U.S. Cl. ..... 5/93.1; 5/424; 5/94; 190/1; 190/2; 190/116

[58] Field of Search ..... 5/94, 93.1, 424; 190/1, 190/2, 116

[56] References Cited

U.S. PATENT DOCUMENTS

| | | | |
|---|---|---|---|
| 466,194 | 12/1991 | Snaman, Jr. | 190/2 |
| 1,525,572 | 2/1925 | Dodd | 190/2 |
| 2,537,750 | 1/1951 | Gretschel | 190/116 |
| 2,589,438 | 3/1952 | Schneider | 190/116 |

*Primary Examiner*—Alexander Grosz
*Attorney, Agent, or Firm*—Milton S. Gerstein

[57] ABSTRACT

A portable bassinet made of cardboard which has outer, canopy-housing and an inner box or bassinet-proper for selected insertions into the outer box. One of the four side walls of the inner box is connected to the rest of the inner box only along its lower horizontal edge surface, with the rest of this side wall being free, in order to provide a pivotal safety wall. The safety wall is pivoted to a downward position when the inner box is used as a bassinet, with an infant placed therein, whereby the inner box is prevent from being fully inserted into the outer main box or canopy-housing, in order to prevent accidental suffocation. Handles are provided for aiding in the carrying of the assembly. A first handle is provided on a side wall surface of the inner box which cooperates with a cutout or opening in the corresponding side wall of the outer box. This first handle is removably secured to the inner box by a pair of slots or grooves formed in the side wall surface thereof, with the ends of the handles being inserted therein. Other handles are also provided on the inner box, each serving the dual function of carrying the inner box alone when the inner box is serving as a bassinet proper, for carrying the infant therein, and, also, for retaining the inner box in its partially drawn out or extended position with respect to the outer box, also when serving as a bassinet with a partial covering thereof formed by the outer box.

19 Claims, 2 Drawing Sheets

PORTABLE BASSINET

This application is a continuation-in-part application of Ser. No. 512,768, filed Apr. 23, 1990, now abandoned.

BACKGROUND OF THE INVENTION

The present invention is directed to a portable bassinet especially intended for use while traveling. When traveling with infants for one night or more, it is often difficult to have access to a crib or bassinet in which the infant may sleep. The infant may be required to sleep on a bed with an adult, on a mattress, or even on the floor. The present invention is directed to the provision of providing an easy transportable bassinet that may be facilely set up for use at any location. In the preferred embodiment, the portable bassinet is made of cardboard, and the like, and is disposable after one use or a few uses.

SUMMARY OF THE INVENTION

It is the primary objective of the present invention to provide a portable bassinet, that is easily erected at any location, in which an infant may sleep comfortably and safely.

It is another objective of the invention to provide such a portable bassinet that is made of cardboard, and the like, and is disposable after one or more uses.

It is still another objective of the present invention to provide such a portable bassinet that is comprised of an outer box or canopy-housing which receives therein a slidable inner box or bassinet-proper, whereby the outer box, among other uses and functions, provides a feeling of security and warmth to the infant when placed in the inner box, by virtue of the fact that the outer box may be used to partially cover the inner box and, therefore, the baby therein.

It is yet another objective of the invention to ensure that the inner box cannot be slid completely into the outer box when a baby is lying in the inner box, in order to prevent accidental suffocation.

It is an objective of the invention to provide carrying handles on the inner box by which the combined outer-/inner box assembly may be easily carried in the closed state thereof, in the partially opened state thereof when serving as a bassinet, and in the fully removed state of the inner box.

Toward these and other ends, the portable bassinet of the invention has an outer, main box or canopy-housing defining three upstanding side walls, a top wall, a bottom wall, and one open end for slidingly-receiving therein an inner box or bassinet-proper for selected insertions into the outer box. The inner box has a bottom wall, four side walls, and an open top for placing an infant in the interior thereof. One of the four side walls is connected to the rest of the inner box only along its lower horizontal edge surface, with the rest of this side wall being free, in order to provide a pivotal safety wall. The safety wall is pivoted to a downward position when the inner box is used as a bassinet, with an infant placed therein, whereby the inner box is prevent from being fully inserted into the outer main box or canopy-housing, in order to prevent accidental suffocation. The safety wall is pivoted to its vertical state when the inner box is to be reinserted into the outer box for storage and/or carrying of the assembly. When the inner box serves as a bassinet proper, the outer box partially telescopes over the inner box or bassinet proper to provide a feeling of comfort, warmth and safety to the infant by serving as a roof, whereby a more confined, warmer and secure volume is provided for the infant.

The bassinet assembly of the invention may be used as a suitcase for storing and carrying items when the inner box is slid entirely into the outer box. Handles are provided for aiding in the carrying of the assembly. A first handle is provided on a side wall surface of the inner box which cooperates with a cutout or opening in the corresponding side wall of the outer box. This first handle is removably secured to the inner box by a pair of slots or grooves formed in the side wall surface thereof, with the ends of the handles being inserted therein. Such a handle-arrangement allows the handle to lie substantially flat against the inner box's side wall surface when closing or inserting the inner box into the outer box, and allows the handle to be drawn or pulled outwardly via the cutout or opening in the outer box's side wall, whereby the handle may be used for carrying the box-assembly. Other handles are also provided on the inner box, each serving the dual function of carrying the inner box alone when the inner box is serving as a bassinet proper, for carrying the infant therein, and, also, for retaining the inner box in its partially drawn out or extended position with respect to the outer box, also when serving as a bassinet with a partial covering thereof formed by the outer box. This provides additional precaution against any accidental complete insertion of the inner box into the outer box when the infant is placed in the inner box, as well as providing carrying handles for the bassinet with the outer housing box, by which the partially-opened assembly may be carried thereby. These handles, like the first handle, are received in slots or grooves in the wall surfaces of the inner box, and retain the inner box and outer box in their partially telescoping positions by also inserting the end of the respective handle through another slot formed in the outer box's side wall.

BRIEF DESCRIPTION OF THE DRAWING

The invention will be more readily understood with reference to the accompanying drawing, wherein.

DETAILED DESCRIPTION OF THE INVENTION

Figure 1:
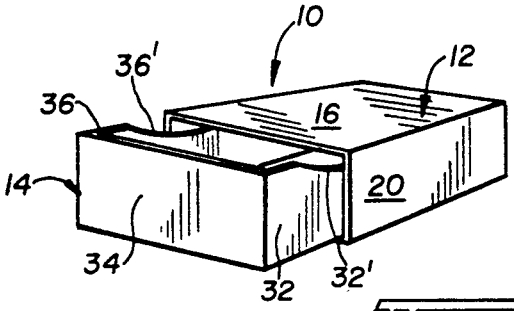
FIG. 1 is a perspective view showing the portable bassinet of the invention.
Figure 2:
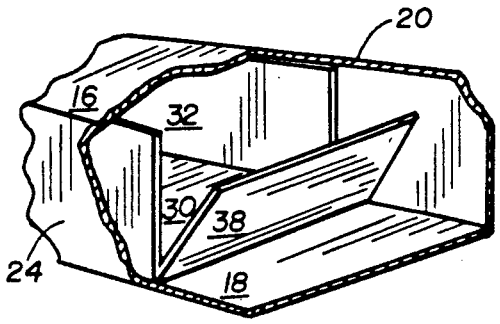
FIG. 2 a broken-away detail view, in perspective, showing the pivotal end safety flap.
Figure 3:
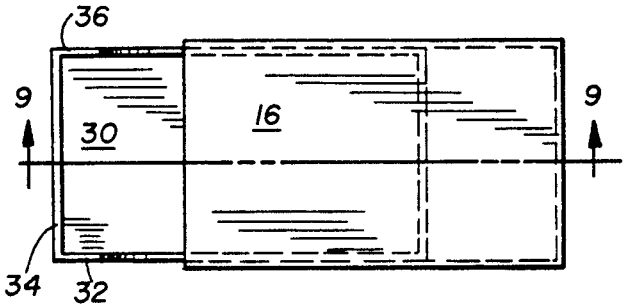
FIG. 3 is a top view of the portable bassinet of the invention.
Figure 4:
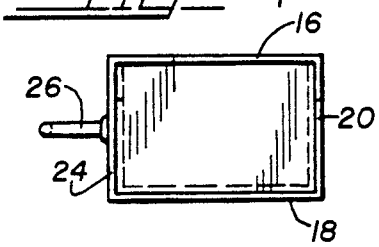
FIG. 4 is an end view thereof.
Figure 5:
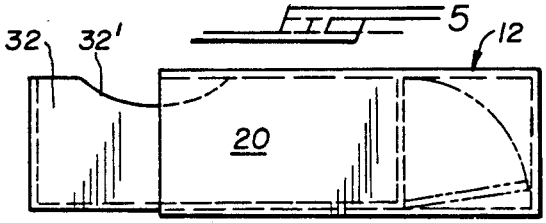
FIG. 5 is a side view thereof.
Figure 6:
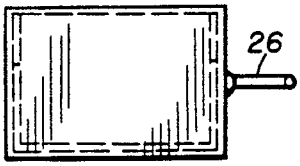
FIG. 6 is another end view thereof.
Figure 7:
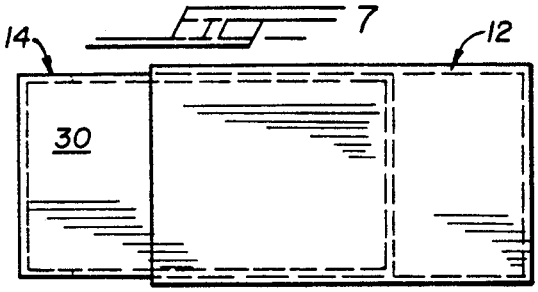
FIG. 7 is a bottom view thereof.
Figure 8:
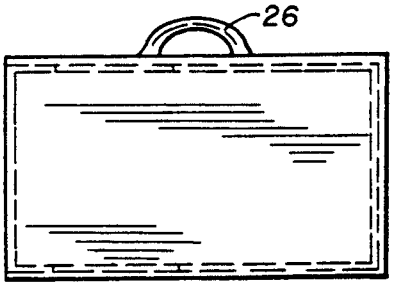
FIG. 8 is a top view thereof with the interior bassinet-box completely enclosed within the outer box housing.
Figure 9:
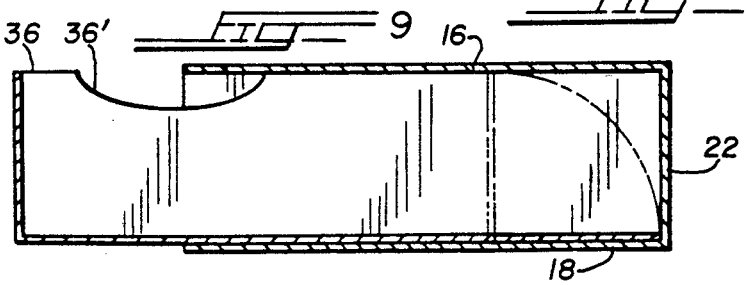
FIG. 9 is a cross-sectional view taken along line 9—9 of FIG. 3.

Referring now to the drawings in greater detail and to FIGS. 1-9, the portable bassinet of the invention is indicated generally by reference numeral 10. The portable bassinet includes an outer box-housing or canopy 12, and an inner box or bassinet proper 14, both of which are preferably made of cardboard, paperboard, kraftboard, etc., so as to be light in weight, and disposable after one or a few uses thereof. The outer box-housing or canopy 12 defines a top wall 16, bottom wall 18, and three side walls 20, 22, 24, and has an open front for telescopingly receiving therein the inner box 14. A handle 26 is secured to one of the walls by which the entire unit 10 may be carried. The inner box or bassinet proper 14 is open on the top, and has a bottom wall 30, and four side walls 32, 34, 36, 38. Each of the two side walls 32, 36 is provided with a cutout 32', 36', respectively, on the upper portion thereof to define a forward upper edge surface portion that is gracefully concave in shape, in order to make the inner box appear as a bassinet, and also to ensure greater air-ventilation for an infant lying in the interior of the inner box, when the inner box has been partially removed form the outer box. The side wall, or end wall, 38 is connected to the rest of the inner box only along its lower edge surface to the corresponding, juxtapositioned edge surface of the bottom wall, whereby this wall 38 is allowed pivotal movement between a substantially vertical orientation and a substantially horizontal orientation. In the vertical orientation, the side wall allows complete insertion of the inner box into the outer box, whereas in its substantially horizontal position, it prevents such complete insertion, so as to prevent accidental suffocation of the infant placed in the inner box-bassinet. Thus, the wall 38 serves as a safety flap.

The combined unit 10 may be used as a storage unit when not in use, and as a travel case for transporting and storing articles or clothing, until such time as it is needed as a bassinet. When used as a bassinet, the outer box serves as a canopy for the infant lying in the inner box, to provide warmth and the feeling of security.

Referring to FIGS. 10-13, there is shown a modification 10' of the bassinet. The bassinet 10' is identical to the bassinet 10 except for the provision of removable handles and associated openings in the inner and outer boxes for accommodating the handles for use according to the invention. The outer box 12' is provided with a pair of linear openings or channels 50, 52 formed respectively in its side walls 20', 24'. The inner box 14' is provided with a first pair of spaced-apart vertical slots 54, 56 for receiving the ends of a conventional type of removable handle 58. The handle 58 has a length that allows it to be moved relatively to the surface face of the wall to which it is mounted. The handle 58 is made of plastic, and defines two ends 60, 62, each of which is formed as a securing member for insertion into a respective slot 54, 56 for removably retaining the handle 58 in place. Each securing member is substantially a T-shaped configuration, and by which insertion and removal of the ends of the handle are accomplished. Each parallel side wall 32', 36' of the inner bassinet box is provided with such a pair of slots 54, 56 and associated handle 58. The handle 58 is respectively positionable relative to the surface face of the respective side wall by pushing it in or pulling it out, with the outward-most position being determined by the securing ends 60, 62 abutment against the interior surface of the respective wall. Each pair of slots 54, 56 is provided on the respective side wall at the same level as the opening or channel 50, 52, so that the handle 58 lies substantially in the same horizontal plane as the associated channel 50 or 52, for linear alignment therewith. Thus, when the inner box is completely received within the outer box, each handle 58 projects outwardly through the associated channel 50 or 52, by which the entire unit 10' may be carried and transported. During the insertion of the inner box into the outer box, each handle 58 is forced inwardly against the respective side wall of the inner box by the interior surface of the juxtapositioned side wall of the outer box, such inward movement causing the securing T-shaped ends 60, 62 to move inwardly into the interior of the inner box. After the inner box has been completely inserted into the outer box, each handle 58 may then be pulled outwardly through the respective channel 50 or 52, with the outward-most position thereof being determined by the securing ends 60, 62, and their abutment against the interior surface of the side wall of the inner box.

Figure 10:
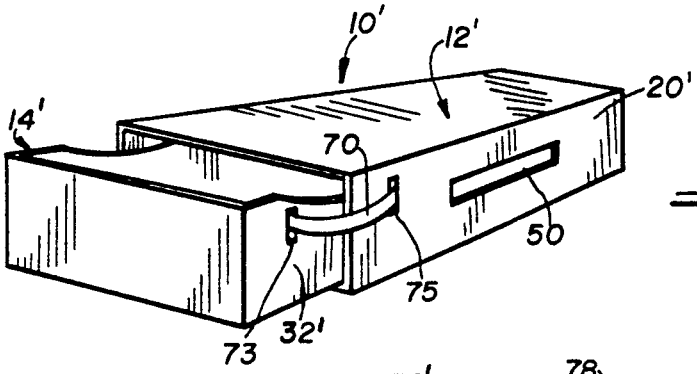
FIG. 10 is a perspective view of the portable bassinet of the invention showing a modification of the invention in which there are provided appropriately-placed slots and grooves for removably receiving handles for use in carrying the outer box/inner box as a unit when closed up, and also for carrying the unit when the inner bassinet box is partially removed from the outer box, which handles may also be used to prevent the inner box from sliding back into the outer box.
Figure 11:
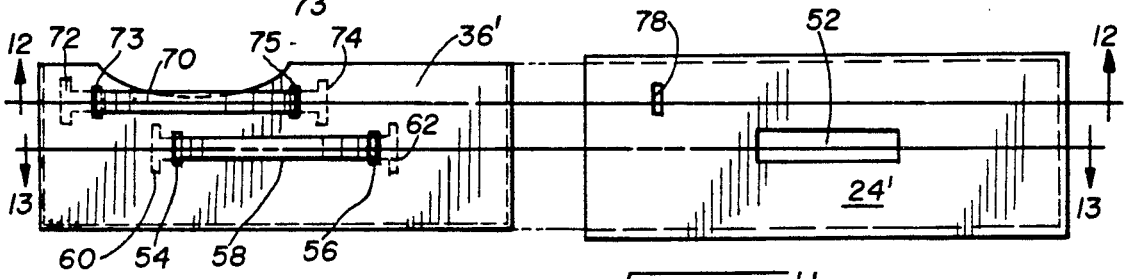
FIG. 11 is an assembly view, in side elevation, showing the inner and outer boxes.
Figure 12:
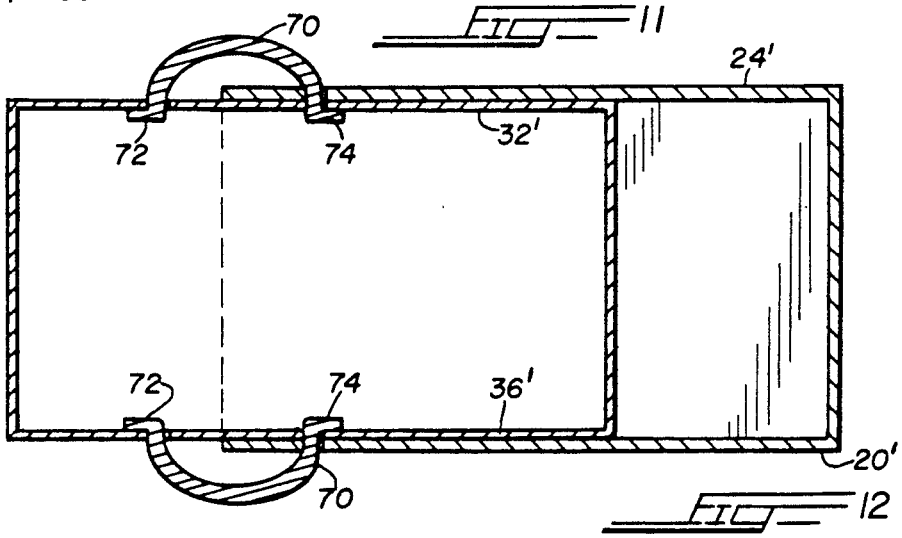
FIG. 12 is a cross-sectional view taken along line 12—12 of FIG. 11 and showing the inner bassinet box partially extended from the outer canopy-box and retained in that position by handles.
Figure 13:
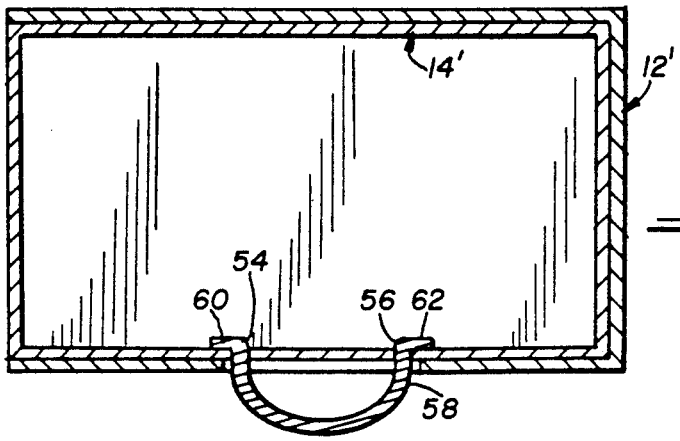
FIG. 13 is a cross-sectional view taken along line 13—13 of FIG. 11, but showing the two boxes in their completely closed state.

The inner bassinet box is also provided with another pair of handles 70 on the same side walls as the handles 58. Each handle 70 is similar to the handle 58, and has T-shaped securing ends 72, 74 like the ends 60, 62 of the handle 58. Each side wall has another pair of vertical slots 73, 75 positioned above the pair of slots 54, 56 and somewhat forwardly thereof, which slots receive the securing ends 72, 74 of the handle 70. Provided on each side wall 20', 24' of the outer box 12' is a single vertical slot 78. This slot 78 is positioned in the forward portion of the side wall, so that when the inner box is partially pulled out, as seen in FIG. 10, the single slot 78 is aligned and positioned over one of the pair of slots 73, 75. The single slot 78 allows passage therethrough of a portion of the handle 70 as seen in FIG. 11, so that the handle 70 passes through the slot 78 before the respective securing end enters one of the pair of slots 73, 75. Depending upon how far the inner box is pulled out of the outer box, one or the other of the pair of slots may be aligned with the single slot 78, so that one or the other securing ends 72, 74 will pass through the single slot 78. This structure ensures that the inner box cannot be completely inserted into the outer box, since the single slot's passage of the handle 70 will prevent such to occur, which is an additional safety feature of the invention for preventing accidental suffocation of an infant. The handles 70 also serve the function of allowing the carrying of the unit 10' when the inner box is partially extended, as shown in FIG. 10. In addition if it is desired to remove the inner box entirely from the outer box, the handles 70 are used to carry the independent and separated bassinet proper 14', which, in this case, the single slot 78 is not used at all, i.e., the handle is not passed therethrough at all, in the manner shown in FIG. 11. The removable nature of the handles 70 from the vertical slots allow for the different usages and functions thereof. When the inner box is completely stored in the outer box, the handles 70 are Pushed inwardly in the same manner as the handle 58, as described above. It is also possible to make the unit 10 or 10' of light-weight plastic.

While a specific embodiment of the invention has been shown and described, it is also within the scope of the invention to decrease its size for use as a child's toy bassinet for play with dolls and toys.

What I claim is:

1. A portable bassinet and carrying unit comprising:

an outer enclosure member (12) having a substantially hollow interior, a top wall, a bottom wall, a pair of side walls, an end wall, and an open entrance end;

an inner member (14) that is telescopingly slidable within said outer enclosure member via said open entrance end, said inner member having a substantially hollow interior and an open top for receiving therein a baby, and the like, to serve as a portable bassinet;

said inner member comprising a pair of side walls, a bottom wall, and a first end wall; and adjustable retaining means (38) for restricting movement of said inner member into said outer enclosure member for preventing the complete insertion of said inner member into said outer member, in order to prevent suffocation.

2. The portable bassinet and carrying unit according to claim 1, wherein said adjustable retaining means comprises a pivotal second end wall (38) of said inner member, said second end wall comprising a lower edge surface, a pair of side edge surfaces, and an upper edge surface, said bottom wall comprising a first forward edge surface and a second rear edge surface, said lower edge surface of said second end wall being connected to said second rear edge surface of said bottom wall, said pair of side edge surfaces and said upper edge surface of said second end wall being disconnected from other said walls to allow for the pivotal movement of said second end wall about said lower edge surface thereof.

3. The portable bassinet and carrying unit according to claim 1, wherein each of said inner member and said outer enclosure member is made of paperboard.

4. The portable bassinet and carrying unit according to claim 1, wherein at least one of said pair of side walls of said inner member comprises a pair of spaced-apart slots (54,56), said inner member further comprising a removable handle (58) having a main portion and first and second securing end (60,62) connected to the ends of said main portion, said pair of spaced-apart slots passing therethrough said first and second securing ends, respectively, by which said handle is removably retained thereat;

at least one of said pair of side walls of said outer enclosure member comprising an opening (50) through which said handle may project when said inner member is received completely in said outer enclosure member.

5. The portable bassinet and carrying unit according to claim 4, wherein each of said pair of side walls of said inner member comprises a pair of spaced-apart slots and a handle, and each of said side walls of said outer enclosure member comprises an opening for receiving therethrough a respective said handle.

6. The portable bassinet and carrying unit according to claim 4, wherein said spaced-apart slots are spaced apart horizontally, and said opening of said at least one side wall of said outer enclosure member is in substantial horizontal linear alignment therewith; said main portion of said handle being movable within said spaced-apart slots for movement toward and away from said at least one side wall of said inner member, whereby the inner member may be completed inserted in said outer enclosure member without obstruction from said handle, and whereby said handle may thereafter be pulled outwardly through said opening of said at least one side wall of said outer enclosure member.

7. The portable bassinet and carrying unit according to claim 1, wherein said retaining means comprises a pair of spaced-apart slots (73,75) in at least one of said pair of side walls of said inner member, and further comprising a removable handle (70) having a main portion and a first and a second securing end (72,74) connected to the ends of said main portion, said pair of spaced-apart slots passing therethrough said first and second securing ends, respectively, by which said handle is removably retained thereat;

said outer enclosure member having a third slot (78) for cooperating with said pair of slots of said inner member, said main portion of said handle passing through third slot with said first and second securing ends passing through said pair of spaced-apart slots, whereby said inner member is prevented from being completely inserted into said outer enclosure member in order to prevent accidental suffocation of an infant in said inner member.

8. The portable bassinet and carrying unit according to claim 7, wherein each of said pair of side walls of said inner member comprises a pair of spaced-apart slots and a handle, and each of said side walls of said outer enclosure member comprises a third slot for receiving therethrough a respective main portion of said handle.

9. The portable bassinet and carrying unit according to claim 7, wherein each of said pair of side walls (20',24') of said inner member comprises another pair of spacer-apart slots (54,56), said inner member further comprising another removable handle (58) having a main portion and a first and a second securing end connected to the ends of said main portion, said another pair of spaced-apart slots passing therethrough said first and second securing ends of said another handle, respectively, by which said handle is removably retained thereat;

at least one of said pair of side walls of said outer enclosure member comprising an opening (52) through which said another handle may project when said inner member is received completely in said outer enclosure member.

10. The portable bassinet and carrying unit according to claim 7, wherein said retaining means further comprises a pivotal second end wall (38) of said inner member, said second end wall comprising a lower edge surface, a pair of side edge surfaces, and an upper edge surface, said bottom wall comprising a first forward edge surface and a second rear edge surface, said lower edge surface of said second end wall being connected to said second rear edge surface of said bottom wall, said pair of side edge surfaces and said upper edge surface of said second end wall being disconnected from other said walls to allow for said rotation of said second end wall about said lower edge surface thereof.

11. A portable bassinet and carrying unit comprising:

an outer enclosure member (12') having a substantially hollow interior, a top wall, a bottom wall, a pair of side walls, an end wall, and an open entrance end;

an inner member (14') that is telescopingly slidable within said outer enclosure member via said open entrance end, said inner member having a substantially hollow interior and an open top for receiving therein a baby, and the like, to serve as a portable bassinet;

said inner member comprising a pair of side walls, a bottom wall, a first end wall, and a second end wall;

at least one of said pair of side walls of said inner member comprises a pair of spacer-apart slots (54, 56), said inner member further comprising a removable handle (58) having a main portion and first and second securing end (60,62) connected to the ends of said main portion, said pair of spaced-apart slots passing therethrough said first and second securing ends, respectively, by which said handle is removably retained thereat.

12. The portable bassinet and carrying unit according to claim 11, wherein at least one of said pair of side walls of said outer enclosure member comprises an opening through which said handle may project when said inner member is received completely in said outer enclosure member.

13. The portable bassinet and carrying unit according to claim 12, wherein each of said pair of side walls of said inner member comprises a pair of spaced-apart slots and a handle, and each of said side walls of said outer enclosure member comprises an opening for receiving therethrough a respective said handle.

14. The portable bassinet and carrying unit according to claim 13, wherein said spaced-apart slots are spaced apart horizontally, and said opening of said at least one side wall of said outer enclosure member is in substantial horizontal linear alignment therewith; said main portion of said handle being movable within said spaced-apart slots for movement toward and away from said at least one side wall of said inner member, whereby the inner member may be completed inserted in said outer enclosure member without obstruction from said handle, and whereby said handle may thereafter be pulled outwardly through said opening of said at least one side wall of said outer enclosure member.

15. The portable bassinet and carrying unit according claim 11, wherein said inner member comprises another pair of spaced-apart slots (73,75), said inner member further comprising another removable handle (70) having a main portion and a first and a second securing end (72,74) connected to the ends of said main portion, said another pair of spaced-apart slots passing therethrough said first and second securing ends of said handle, respectively, by which said handle is removably retained thereat;

at least one side wall of said outer enclosure member comprising an opening (78) through which said another handle may project when said inner member is received completely in said outer enclosure member;

each of said pair of side walls of said inner member comprising a concave-like cutout formed in the upper portion thereof whereby the upper edge surface of each said side wall is gracefully contoured and also allows for enhanced ventilation.

16. A method of using a portable bassinet for an infant, which bassinet comprises an outer enclosure member having a substantially hollow interior, a top wall, a bottom wall, a pair of side walls, an end wall, and an open entrance end, and an inner bassinet-member that is telescopingly slidable within said outer enclosure member via said open entrance end, said inner member having a substantially hollow interior and an open top for receiving therein a baby, and the like, to serve as a portable bassinet;

said inner member comprising a pair of side walls, a bottom wall, a first end wall, and a second end wall, said method comprising:

a) partially removing the inner member from the outer member so that the inner member is partially covered over by said outer member;

b) thereafter, retaining said inner member in the partially-removed position achieved by said step (a), said step of retaining preventing the accidental complete insertion of said inner member into said outer member.

17. The method according to claim 16, further comprising:

c) placing an infant in said inner member, with said outer member serving as a canopy for the inner member.

18. The method according to claim 16, wherein said step (b) comprises pivoting the second end wall of the inner member away from the rest of the inner member to provide an obstruction to the complete insertion of the inner member into the outer member.

19. The method according to claim 16, wherein said step (b) comprises inserting a first end of a handle through a first slot of a pair of spaced apart slots in one side wall of the inner member, passing a second end of the handle through a third slot in the juxtapositioned side wall of the outer enclosure member, thereafter passing the second end through the second slot of the pair of spaced apart slots in the side wall of the inner member.

* * * * *

UNITED STATES PATENT AND TRADEMARK OFFICE

CERTIFICATE OF CORRECTION

PATENT NO. : 5,038,426

DATED : AUGUST 13, 1991

INVENTOR(S) : DALIAH BORETSKI

It is certified that error appears in the above-identified patent and that said Letters Patent is hereby corrected as shown below:

Column 5, line 11, "an end wall," should be deleted;

Column 6, line 64, "an end wall," should be deleted;

Column 7, line 14, "an end wall," should be deleted.

Signed and Sealed this

Eighth Day of December, 1992

*Attest:*

DOUGLAS B. COMER

*Attesting Officer*

*Acting Commissioner of Patents and Trademarks*